US006470798B1

(12) United States Patent
Hiwatashi et al.

(10) Patent No.: US 6,470,798 B1
(45) Date of Patent: Oct. 29, 2002

(54) SHEET-LIKE MATERIAL GUIDE APPARATUS OF PERFECTING PRESS

(75) Inventors: Masakazu Hiwatashi; Isao Komuro; Tomoya Kanayama; Akehiro Kusaka, all of Chiba (JP)

(73) Assignee: Komori Corporation, Tokyo (JP)

( * ) Notice: Subject to any disclaimer, the term of this patent is extended or adjusted under 35 U.S.C. 154(b) by 12 days.

(21) Appl. No.: 09/809,306

(22) Filed: Mar. 16, 2001

(30) Foreign Application Priority Data

Mar. 17, 2000 (JP) ..... 2000-075045

(51) Int. Cl.[7] ..... B41F 5/02
(52) U.S. Cl. ..... 101/231; 101/232; 271/409
(58) Field of Search ..... 101/183, 217, 101/229, 230, 231, 232, 409; 271/195, 309

(56) References Cited

U.S. PATENT DOCUMENTS 4,869,166 A * 9/1989 Mathes ..... 101/230
5,156,090 A * 10/1992 Wirz ..... 101/142
5,598,779 A * 2/1997 Haas et al. ..... 101/183
6,254,094 B1 * 7/2001 Becker et al. ..... 271/189
6,302,021 B1 * 10/2001 Wadlinger ..... 101/216

FOREIGN PATENT DOCUMENTS

JP 2612594 12/1989
JP 22595 1/1990

* cited by examiner

*Primary Examiner*—Ren Yan

(57) ABSTRACT

A paper guide apparatus of a perfecting press is disclosed. The perfecting press comprises a blanketed impression cylinder which has a holding device for holding paper and prints one side of the paper, and a blanket cylinder which is in contact with the blanketed impression cylinder and prints the other side of the paper. The blanketed impression cylinder and the blanket cylinder are arranged nearly horizontally. In the paper guide apparatus, suction chambers for sucking and guiding the paper transported by the blanketed impression cylinder are provided between a transfer cylinder located directly ahead of the blanketed impression cylinder and the blanket cylinder, and an air nozzle is provided for blowing air between the paper transferred from the transfer cylinder to the blanketed impression cylinder and the circumferential surface of the blanketed impression cylinder. The paper guide apparatus prevents trouble in printing, such as doubling or smudging, due to a touch of the paper to the circumferential surface of the cylinder before a printing pressure is applied.

7 Claims, 4 Drawing Sheets

SHEET-LIKE MATERIAL GUIDE APPARATUS OF PERFECTING PRESS

The entire disclosure of Japanese Patent Application No. 2000-075045 filed on Mar. 17, 2000 including specification, claims, drawings and summary is incorporated herein by reference in its entirety.

BACKGROUND OF THE INVENTION

1. Field of the Invention

This invention relates to a sheet-like material guide apparatus of a perfecting press which prints both sides of a sheet-like material. More specifically, the invention relates to a sheet-like material guide apparatus for preventing double printing (doubling) or smudging of a sheet-like material caused when the sheet-like material touches an image on a circumferential surface of a printing cylinder before printing is performed.

2. Description of the Related Art

The above type of apparatus is disclosed, for example, in Japanese Utility Model Publication No. 1990-2595. This apparatus prints both sides of a sheet-like material at a point of contact between an upper blanket cylinder and a lower blanket cylinder. In order that the sheet-like material may not contact the upper blanket cylinder before being printed at the point of contact, the apparatus takes the following guiding measures: $\hat{1}$ A clearance is provided between a transfer cylinder and the upper blanket cylinder. $\hat{2}$ A vacuum is applied to the circumferential surface of the transfer cylinder to attract the sheet-like material by suction to the circumferential surface of the transfer cylinder. $\hat{3}$ The peripheral speed of the transfer cylinder is made slightly higher than the peripheral speed of the upper blanket cylinder. $\hat{4}$ A paper guide is provided for guiding the sheet-like material to the point of contact between the upper blanket cylinder and the lower blanket cylinder to prevent contact of the sheet-like material with the upper or lower blanket cylinder. Because of these measures, the sheet-like material, which is gripped by a gripper device of the upper blanket cylinder and guided toward the aforesaid point of contact (printing unit), is fed by the transfer cylinder while being in intimate contact with the circumferential surface of the transfer cylinder without touching the upper blanket cylinder. At this time, a trailing edge of the sheet-like material is fed at a slightly higher speed than the speed of an end of the sheet-like material gripped by the upper blanket cylinder. The fed sheet-like material travels downward and moves along the paper guide. Thus, the sheet-like material does not make contact with a site near a point of gripping change from the transfer cylinder to the upper blanket cylinder, or with the lower blanket cylinder, nor does the sheet-like material contact the upper blanket cylinder at a site close to the printing unit. Hence, trouble in printing, such as doubling or smudging, can be prevented, resulting in a marked improvement of the quality of a printing product, and a decrease in the amount of wasted paper.

The foregoing apparatus of the earlier technology has the upper and lower blanket cylinders arranged vertically in parallel. In this configuration, assume that many plate cylinders are provided in contact with the circumferential surfaces of the blanket cylinders, and an inking device is provided for each of the plate cylinders. In this case, the printing press will become so huge that problems with space and operability will occur. With such a perfecting press, therefore, a pair of blanket cylinders are generally disposed parallel in a horizontal direction, as shown in Japanese Patent No. 2,612,594 (FIG. 1). In the perfecting press shown in Japanese Patent No. 2,612,594, however, a sheet-like material contacts the circumferential surface of the blanket cylinder before being printed at a point of contact between the pair of blanket cylinders, and is thus double printed or smudged. To avoid this trouble, the aforementioned guiding measures $\hat{1}$ to $\hat{4}$ disclosed in Japanese Utility Model Publication No. 1990-2595 may be applied to the perfecting press. In this case, if the paper guide is disposed horizontally, the sheet-like material will move along a guide surface under its own weight. In the perfecting press, however, the guide surface lies vertically. Thus, the sheet-like material moves irregularly without moving along the paper guide, so that doubling or smudging occurs as in a case where the guiding measures are not taken.

SUMMARY OF THE INVENTION

The present invention has been accomplished in consideration of the above-described circumstances. The object of the invention is to provide a sheet-like material guide apparatus of a perfecting press having two printing cylinders arranged nearly horizontally for printing both sides of a sheet-like material, the sheet-like material guide apparatus being capable of preventing trouble in printing, such as doubling or smudging, caused by the sheet-like material touching the circumferential surface of the printing cylinder before being printed.

According to the present invention, which attains the above object, there is provided a sheet-like material guide apparatus of a perfecting press comprising a first printing cylinder and a second printing cylinder arranged nearly horizontally, the first printing cylinder having a holding device for holding a sheet-like material and being adapted to print one side of the sheet-like material, and the second printing cylinder being in contact with the first printing cylinder and being adapted to print the other side of the sheet-like material, wherein a suction guide for sucking and guiding the sheet-like material transported by the first printing cylinder is provided between a transport cylinder located immediately ahead of the first printing cylinder and the second printing cylinder, and air blowing means is provided for blowing air between the sheet-like material transferred from the transport cylinder to the first printing cylinder and a circumferential surface of the first printing cylinder.

This feature can prevent a printing trouble, such doubling or smudging, due to the sheet-like material touching the circumferential surface of the cylinder before a printing pressure is applied. Furthermore, the trailing edge of the sheet-like material does not irregularly move. Thus, the printing quality is improved, and the percentage of wasted paper is decreased.

In the sheet-like material guide apparatus, a clearance between a guide surface of the suction guide and the circumferential surface of the first printing cylinder may be progressively narrowed along a flow of the sheet-like material.

In the sheet-like material guide apparatus, transport belts running at nearly the same speed as the transport speed of the sheet-like material may be passed over the suction guide.

In the sheet-like material guide apparatus, the transport cylinder may be slightly spaced from the first printing cylinder, and the peripheral speed of the transport cylinder may be made slightly higher than the peripheral speed of the first printing cylinder, in a range in which transfer of the sheet-like material to the first printing cylinder can be performed.

In the sheet-like material guide apparatus, the suction guide may be divided into a plurality of parts in a flowing direction of the sheet-like material, and the plurality of parts may be connected to a negative pressure source.

In the sheet-like material guide apparatus, the suction guide may be composed of a suction chamber having a plurality of fans disposed in a flowing direction of the sheet-like material, and the sheet-like material may be attracted by suction to a guide surface of the suction chamber which comprises an arc-shaped porous plate.

In the sheet-like material guide apparatus, the air blowing means may have a valve, and the valve may stop blowing of air to a trailing edge of the sheet-like material held by the first printing cylinder.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

A sheet-like material guide apparatus of a perfecting press according to the present invention will now be described in detail by way of its preferred embodiments with reference to the accompanying drawings; however, these embodiments in no way are meant to limit the invention.

[First Embodiment]

Figure 1:
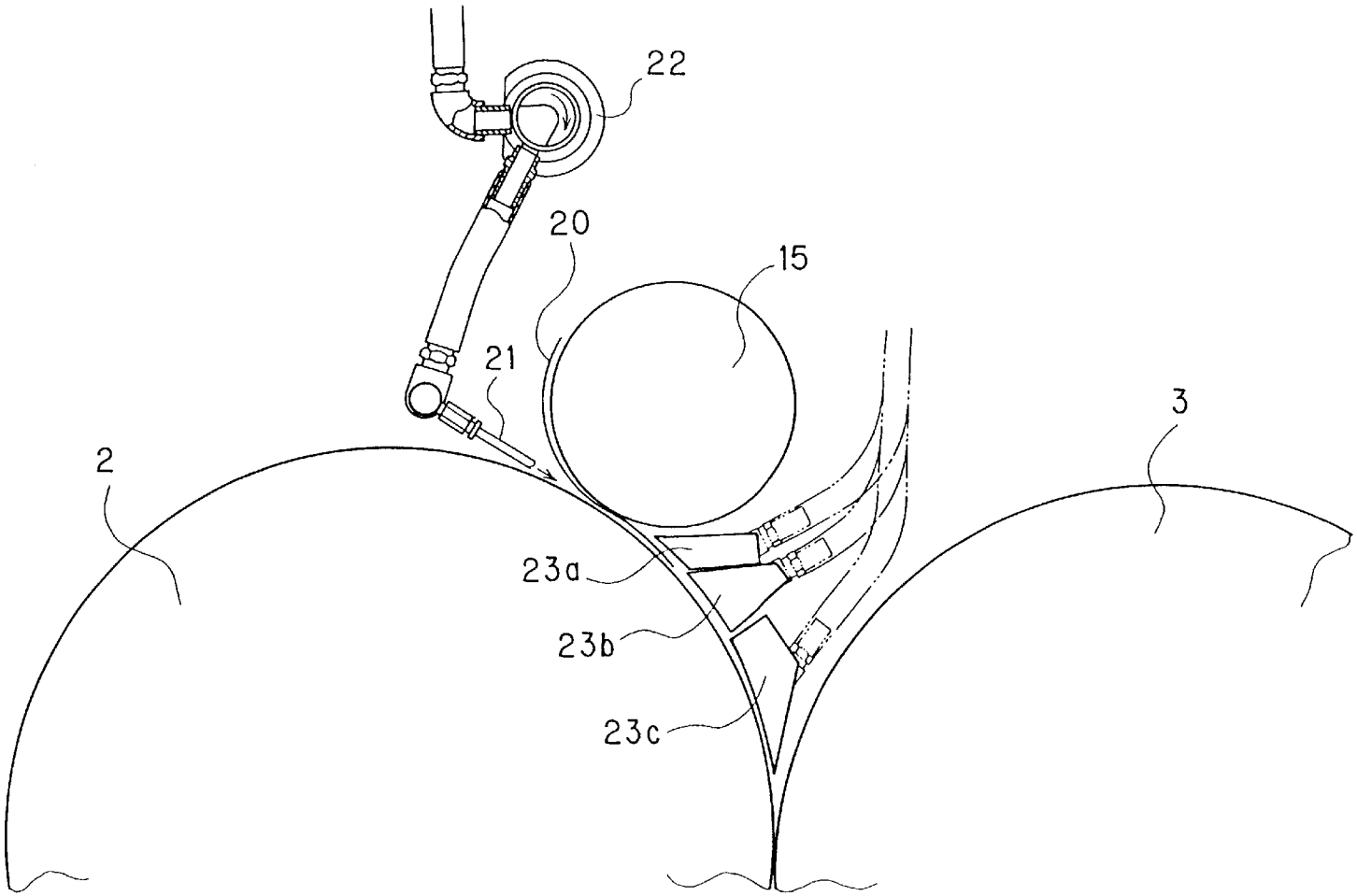
FIG. 1 is an enlarged view of an essential part of a perfecting multicolor offset press showing a first embodiment of the present invention.
Figure 2:
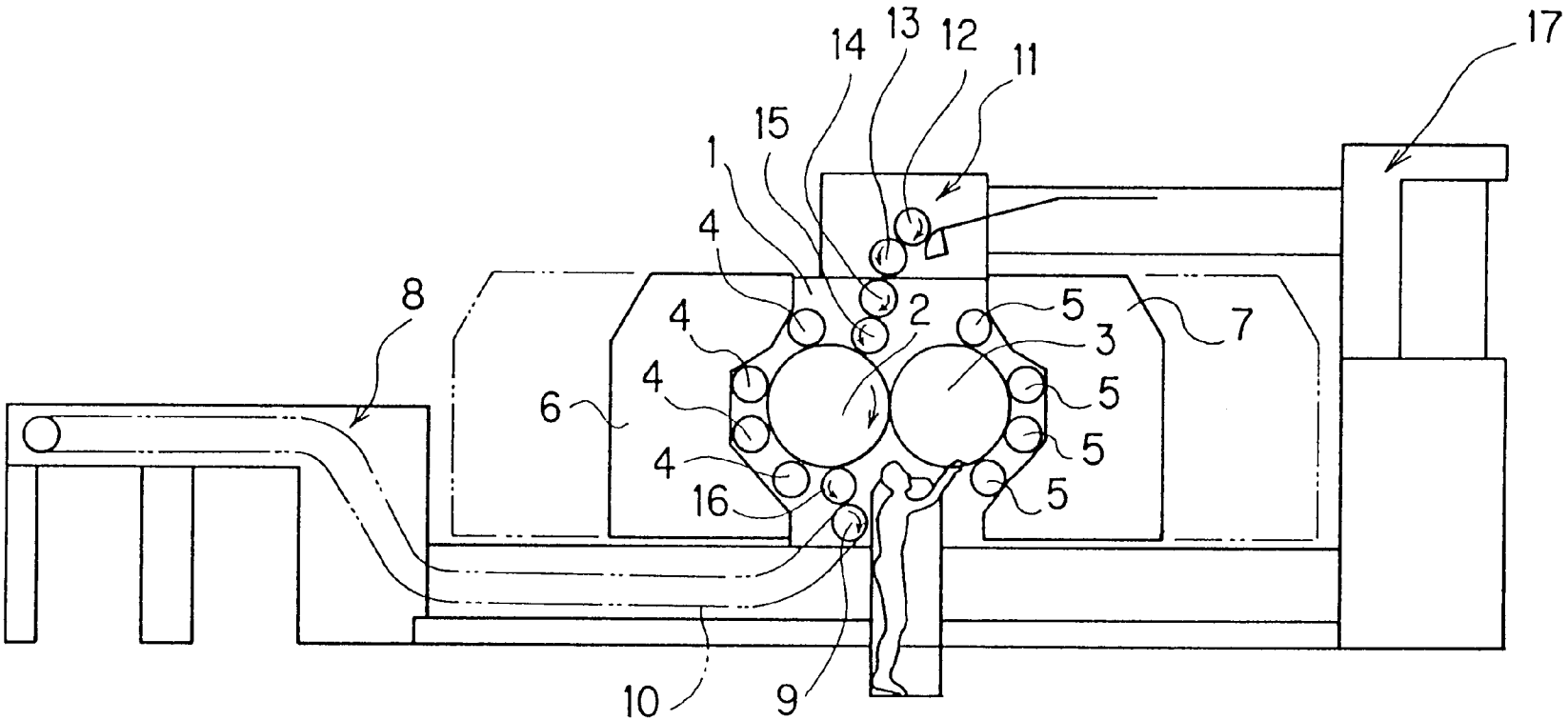
FIG. 2 is a general side view of the perfecting multicolor offset press.

FIG. 1 is an enlarged view of an essential part of a perfecting multicolor offset press showing a first embodiment of the present invention. FIG. 2 is a general side view of the perfecting multicolor offset press.

As shown in FIG. 2, a blanketed impression cylinder (first printing cylinder) 2 having a gripper device (holding device), and a blanket cylinder (second printing cylinder) 3 having no gripper device are horizontally borne in a printing unit 1 of the perfecting multicolor offset press. Circumferential surfaces of the blanketed impression cylinder 2 and the blanket cylinder 3 are in contact with each other. Four plate cylinders 4 are arranged on the circumferential surface of the blanketed impression cylinder 2, and four plate cylinders 5 are also arranged on the circumferential surface of the blanket cylinder 3. Inking units 6, 7 are movably provided so as to be able to approach and leave the plate cylinders 4, 5. The inking units 6, 7 thus can supply ink and water to the plate cylinders 4, 5 while contacting the plate cylinders 4, 5.

A delivery cylinder 9 of a delivery unit 8 is placed below the blanketed impression cylinder 2, and a chain 10 is placed leftwardly of the delivery cylinder 9 in the drawing without crossing a space below a position of contact between the circumferential surfaces of the blanketed impression cylinder 2 and the blanket cylinder 3. There are provided transfer cylinders (transport cylinders) 12 to 15 which have gripper devices and transfer paper (sheet-like material) from a register 11 to the blanketed impression cylinder 2. There is also provided a transfer cylinder (transport cylinder) 16 which has a gripper device and transfers paper from the blanketed impression cylinder 2 to the delivery cylinder 9. Thus, paper, which has been fed from a feeder 17 and positioned by the register 11, is transported along a path indicated by arrows in the drawing, namely, along the circumferential surfaces of the transfer cylinders 12 to 15→blanketed impression cylinder 2→transfer cylinder 6→delivery cylinder 9. When the paper passes the point of contact between the blanketed impression cylinder 2 and the blanket cylinder 3 from above to below, the paper is printed.

In the present embodiment, as shown in FIG. 1, the transfer cylinder 15, as a guide device for paper 20, is slightly spaced from the blanketed impression cylinder 2, and the peripheral speed of the transfer cylinder 15 is made slightly higher than the peripheral speed of the blanketed impression cylinder 2, in a range in which gripping change of the paper 20 by the blanketed impression cylinder 2 can be performed. An air nozzle (air blowing means) 21 for blowing air between the paper 20 and the circumferential surface of the blanketed impression cylinder 2 is provided upstream from the point of gripping change from the transfer cylinder 15 to the blanketed impression cylinder 2. Midway through air piping between the air nozzle 21 and a pressurized air supply source (such as a compressor; not shown), a rotary valve 22 is mounted for stopping blowing of air to a trailing edge of the paper. A suction chamber (suction guide) is provided between the transfer cylinder 15 and the blanket cylinder 3 along the circumferential surface of the blanketed impression cylinder 2. The suction chamber is divided into a plurality of parts (three parts in the drawing; herein termed suction chambers 23*a* to 23*c*) in a flowing direction of the paper. These suction chambers 23*a* to 23*c* are connected to a negative pressure source (e.g., a vacuum pump; not shown). Clearances between guide surfaces of the suction chambers 23*a* to 23*c*, which comprise arc-shaped porous plates, and the circumferential surface of the blanketed impression cylinder 2 are progressively narrowed in the flowing direction of the paper.

According to the foregoing features, when the paper 20 is transferred from the transfer cylinder 15 to the blanketed impression cylinder 2 after gripping change, and transported toward the contact point (printing point) between the blanketed impression cylinder 2 and the blanket cylinder 3, the paper 20 is attracted by suction to the suction chambers 23*a* to 23*c*, and moved along the guide surfaces. Thus, the paper 20 is transported up to the printing point without touching the circumferential surface of the blanketed impression cylinder 2. Furthermore, air blown from the air nozzle 21 enters between the transferred paper 20 and the circumferential surface of the blanketed impression cylinder 2, so that the paper 20 does not touch the circumferential surface of the blanketed impression cylinder 2. The air pushes out the paper 20 toward the guide surfaces of the suction chambers 23*a* to 23*c*, facilitating suction of the paper 20. Blowing of air to the trailing edge of the paper is stopped to avoid irregular movement of the trailing edge. Besides, the transfer cylinder 15 is slightly spaced from the blanketed impression cylinder 2. Thus, the paper 20 undoubtedly does not touch the circumferential surface of the blanketed impression cylinder 2, and air easily enters the gap between the paper and the circumferential surface of the blanketed impression cylinder 2, thereby promoting ease of suction. In addition, the peripheral speed of the transfer cylinder 15 is slightly higher than the peripheral speed of the blanketed impression cylinder 2, so that the trailing edge of the paper is moderately relaxed, and ease of suction is promoted. The transfer cylinder 15 may be composed of a suction cylinder so that the paper 20 can be attracted by suction to the circumferential surface of the transfer cylinder 15. By so doing, the paper 20 is reliably prevented from touching the circumferential surface of the blanketed impression cylinder 2, and air is admitted more easily, thus increasing ease of suction. What is more, the clearances between the guide surfaces of the suction chambers 23*a* to 23*c* and the circumferential surface of the blanketed impression cylinder 2 are progressively narrowed as the paper flows. Thus, the paper 20 does not fall off, but smoothly travels, up to the contact point (printing point).

According to the present embodiment, as described above, the paper 20 is printed without its prior touch to the circumferential surface of the blanketed impression cylinder 2. Thus, the paper 20 does not smudge. Nor does its trailing edge irregularly move. Hence, the printing quality is improved, and the percentage of wasted paper decreases. In addition, the suction chamber is divided into plural parts, i.e., suction chambers 23*a* to 23*c*. These divisional suction chambers 23*a* to 23*c* are easy to assemble and mount, and their sucking power can be increased.

[Second Embodiment]

Figure 3:
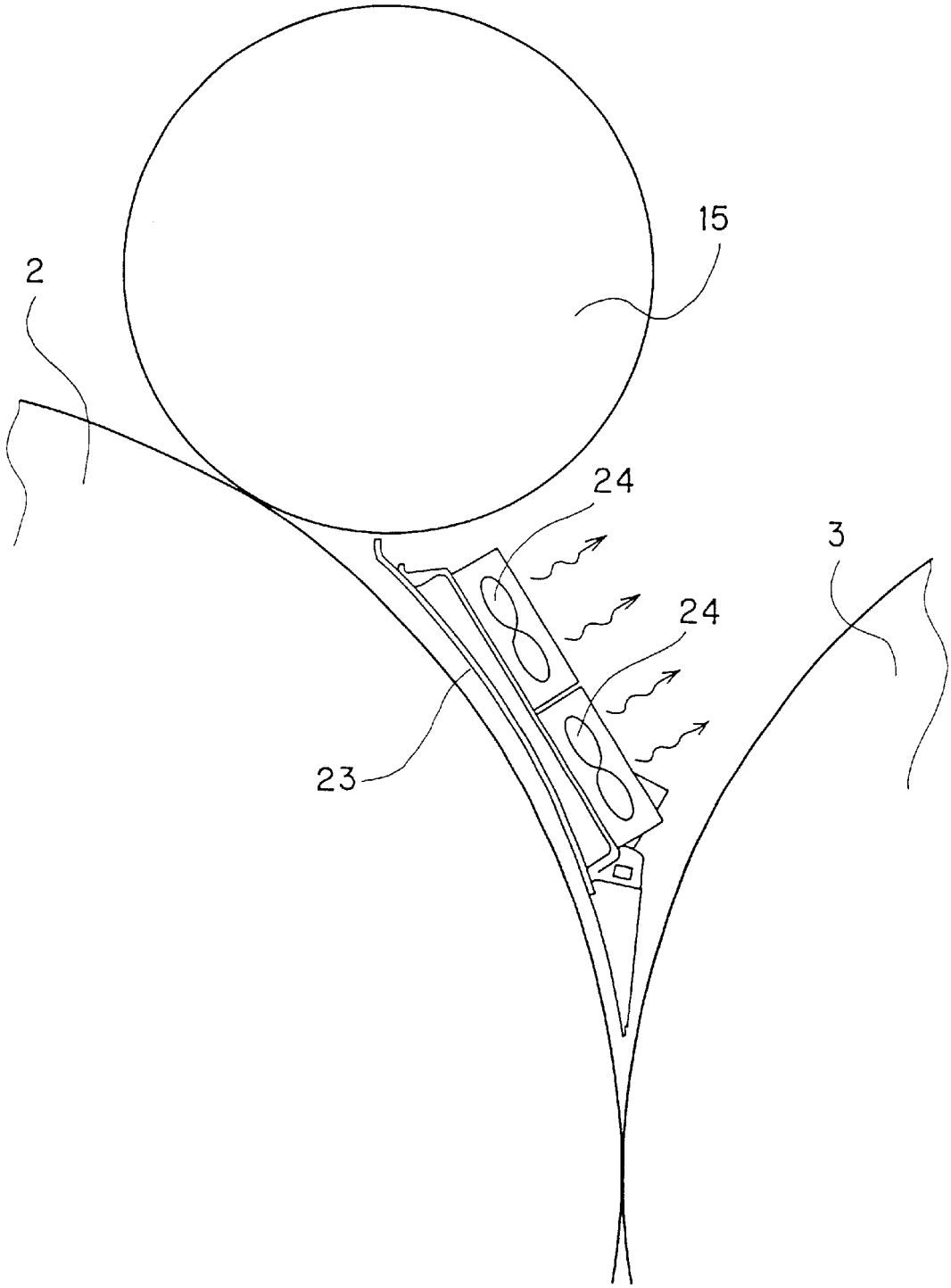
FIG. 3 is an enlarged view of an essential part of a perfecting multicolor offset press showing a second embodiment of the present invention.

FIG. 3 is an enlarged view of an essential part of a perfecting multicolor offset press showing a second embodiment of the present invention.

According to the present embodiment, a plurality of fans 24 are mounted on a suction chamber 23 to attract paper 20 by suction to a guide surface of the suction chamber 23 which comprises an arc-shaped porous plate. Other features of the present embodiment are the same as in the first embodiment. The present embodiment enables the paper 20 to be attracted with a relatively weak force, thus presenting the advantage that the paper flows smoothly along the guide surface.

[Third Embodiment]

Figure 4:
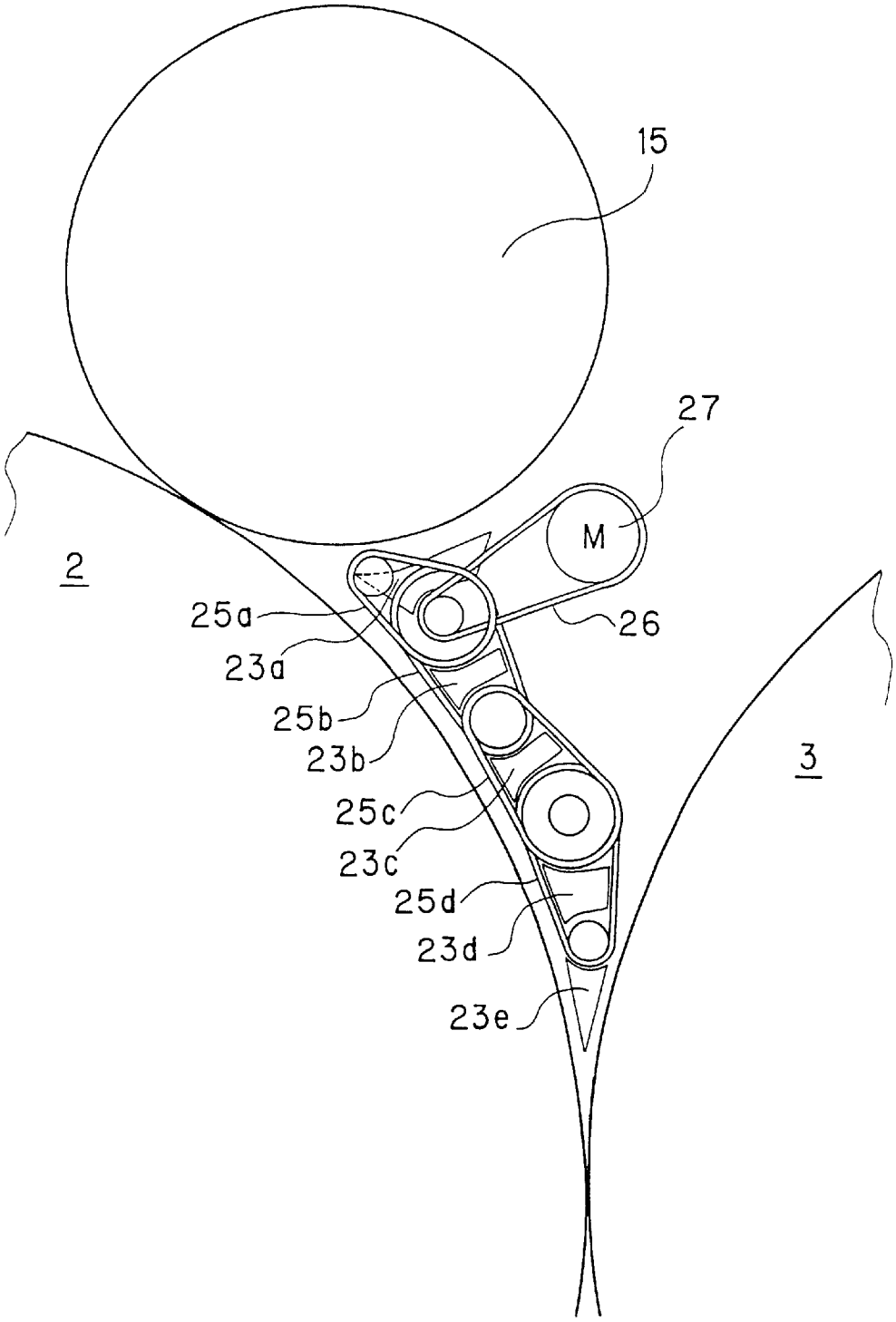
FIG. 4 is an enlarged view of an essential part of a perfecting multicolor offset press showing a third embodiment of the present invention.

FIG. 4 is an enlarged view of an essential part of a perfecting multicolor offset press showing a third embodiment of the present invention.

According to the present embodiment, transport (suction) belts 25*a* to 25*d* are passed over a plurality of suction chambers 23*a* to 23*e,* and the transport belts 25*a* to 25*d* are rotated at the same speed as the peripheral speed (paper speed) of a blanketed impression cylinder 2 by a motor 27 via a drive belt 26. Other features are the same as in the first embodiment. The present embodiment avoids the situation that paper held by a gripper device is dropped off by the sucking force of a suction guide (namely, because of an excessive sucking force). Thus, the paper can be reliably transported. Furthermore, scuff or scratch of the paper due to contact between the paper and the guide surfaces of the suction chambers is prevented, because the transport belts are present between the paper and the guide surfaces.

While the present invention has been described in the foregoing fashion, it is to be understood that the invention is not limited thereby, but may be varied in many other ways. For example, the holding device may be changed from the gripper device to a suction holding device, and the suction chamber may be changed from the divisional suction chambers to an undivided suction chamber. Such variations are not to be regarded as a departure from the spirit and scope of the invention, and all such modifications as would be obvious to one skilled in the art are intended to be included within the scope of the appended claims.

What is claimed is:

1. A sheet-like material guide apparatus of a perfecting press, comprising:

a first printing cylinder and a second printing cylinder arranged nearly horizontally, said first printing cylinder having a holding device for holding a sheet-like material and being adapted to print one side of the sheet-like material, and said second printing cylinder being in contact with said first printing cylinder and being adapted to print other side of the sheet-like material, wherein a suction guide for sucking and guiding the sheet-like material transported by said first printing cylinder is provided between a transport cylinder located directly ahead of said first printing cylinder and said second printing cylinder, and air blowing means is provided for blowing air between the sheet-like material transferred from said transport cylinder to said first printing cylinder and a circumferential surface of said first printing cylinder.

2. The sheet-like material guide apparatus of claim 1, wherein a clearance between a guide surface of said suction guide and the circumferential surface of said first printing cylinder is progressively narrowed along a flow of the sheet-like material.

3. The sheet-like material guide apparatus of claim 1, wherein transport belts running at nearly a same speed as a transport speed of the sheet-like material are passed over said suction guide.

4. The sheet-like material guide apparatus of claim 1, wherein said transport cylinder is slightly spaced from said first printing cylinder, and a peripheral speed of said transport cylinder is made slightly greater than a peripheral speed of said first printing cylinder.

5. The sheet-like material guide apparatus of claim 1, wherein said suction guide is divided into a plurality of parts in a flowing direction of the sheet-like material, and the plurality of parts are connected to a negative pressure source.

6. The sheet-like material guide apparatus of claim 1, wherein said suction guide is composed of a suction chamber having a plurality of fans disposed in a flowing direction of the sheet-like material, and the sheet-like material is attracted by suction to a guide surface of said suction chamber which comprises an arc-shaped porous plate.

7. The sheet-like material guide apparatus of claim 1, wherein said air blowing means has a valve, and said valve stops blowing of air to a trailing edge of the sheet-like material held by said first printing cylinder.

* * * * *